US008910339B1

(12) United States Patent
DeLeon

(10) Patent No.: US 8,910,339 B1
(45) Date of Patent: Dec. 16, 2014

(54) PAINT ROLLER ASSEMBLY

(71) Applicant: Ruben DeLeon, Seattle, WA (US)

(72) Inventor: Ruben DeLeon, Seattle, WA (US)

( * ) Notice: Subject to any disclaimer, the term of this patent is extended or adjusted under 35 U.S.C. 154(b) by 0 days.

(21) Appl. No.: 13/972,461

(22) Filed: Aug. 21, 2013

(51) Int. Cl.
*B05C 17/02* (2006.01)

(52) U.S. Cl.
CPC ..... *B05C 17/02* (2013.01)
USPC ..... 15/230.11; 492/13; 492/19

(58) Field of Classification Search
USPC ..... 15/230.11; 492/13, 19
See application file for complete search history.

(56) References Cited

U.S. PATENT DOCUMENTS

| | | | | |
|---|---|---|---|---|
| 2,702,917 | A * | 3/1955 | Lynden | 15/230.11 |
| 3,593,361 | A | 7/1971 | Welt | |
| 3,604,046 | A | 9/1971 | Taylor | |
| 3,745,624 | A | 7/1973 | Newman | |
| 4,868,946 | A | 9/1989 | Marino et al. | |
| 5,921,905 | A * | 7/1999 | Newman et al. | 492/13 |
| 6,681,438 | B2 * | 1/2004 | Newman et al. | 15/230.11 |
| D498,928 | S | 11/2004 | Zopf | |
| 7,043,793 | B2 * | 5/2006 | Lu | 15/230.11 |
| 7,784,142 | B2 * | 8/2010 | Scott, Sr. | 15/230.11 |
| 8,671,501 | B2 * | 3/2014 | Buckel et al. | 15/230.11 |

* cited by examiner

*Primary Examiner* — Randall Chin

(57) ABSTRACT

A paint roller assembly has adjustable arms for accommodating various sizes of roller cages and accompanying roller skins. The assembly includes an elongated cage. An elongated roller skin has a main body, an open first side, and an open second side wherein the main body, the open first side, and the open second side define an interior space configured for receiving the cage wherein the cage is slidably insertable into the interior space of the roller skin. A pair of arms is selectively couplable to the cage. A head is selectively coupled to each of the arms. A first and second side of the head is selectively couplable to a second side of each of the arms. A slot extends from the first side and the second side of the head wherein the second side of each of the arms is selectively insertable into the slot.

18 Claims, 4 Drawing Sheets

PAINT ROLLER ASSEMBLY

BACKGROUND OF THE DISCLOSURE

Field of the Disclosure

The disclosure relates to paint roller assemblies and more particularly pertains to a new paint roller assembly with adjustable arms for accommodating various sizes of roller cages and accompanying roller skins.

SUMMARY OF THE DISCLOSURE

An embodiment of the disclosure meets the needs presented above by generally comprising an elongated cage. An elongated roller skin has a main body, an open first side, and an open second side wherein the main body, the open first side, and the open second side define an interior space configured for receiving the cage wherein the cage is slidably insertable into the interior space of the roller skin through one of the open first side and the open second side of the roller skin. A pair of arms is selectively couplable to the cage. A head is selectively coupled to each of the arms. A first and second side of the head is selectively couplable to a second side of each of the arms. A slot extends from the first side and the second side of the head wherein the second side of each of the arms is selectively insertable into the slot wherein the second side of each of the arms is configured to extend and retract to a desired length relative to a length of the cage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
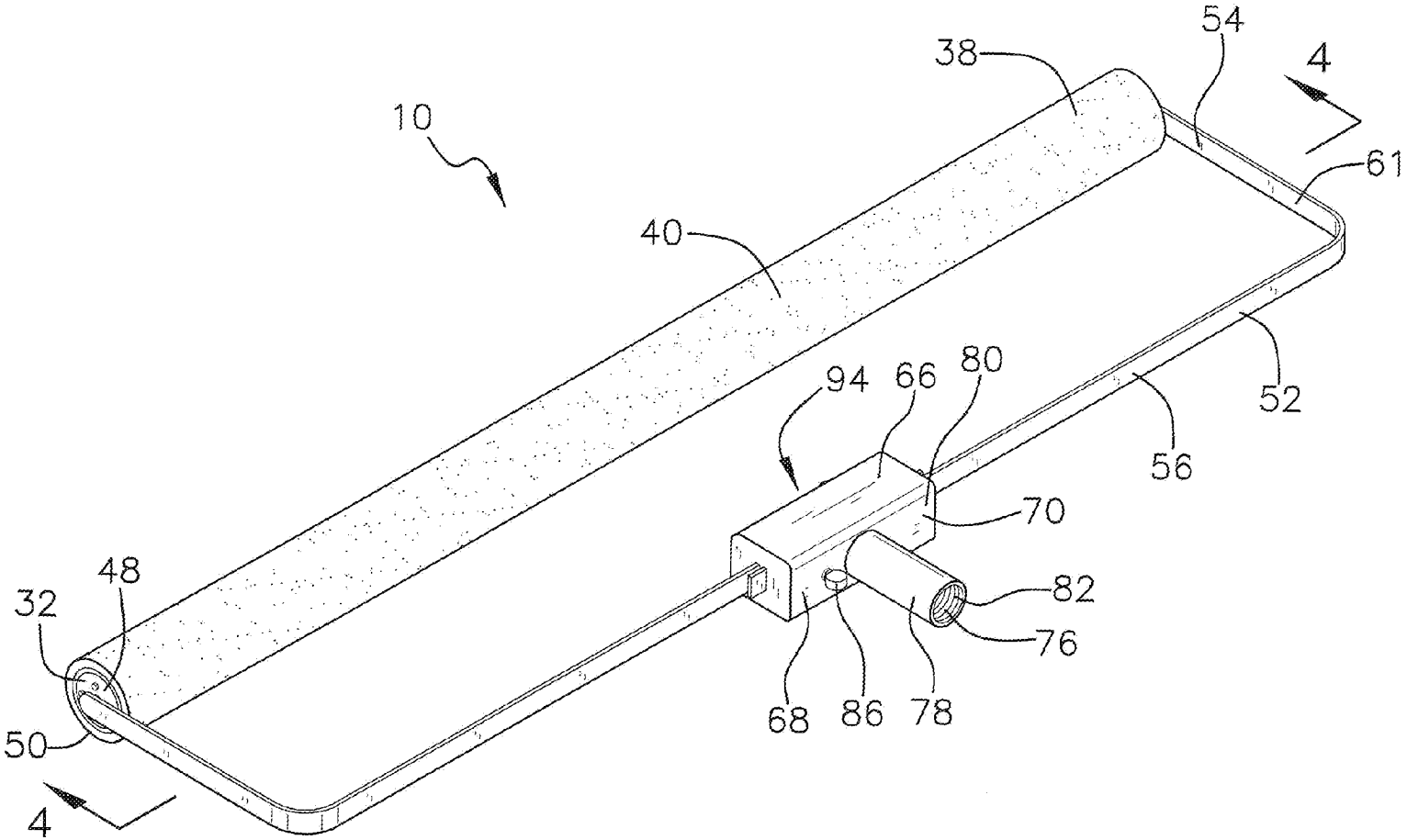
FIG. 1 is a top front side perspective view of a paint roller assembly according to an embodiment of the disclosure.
Figure 2:
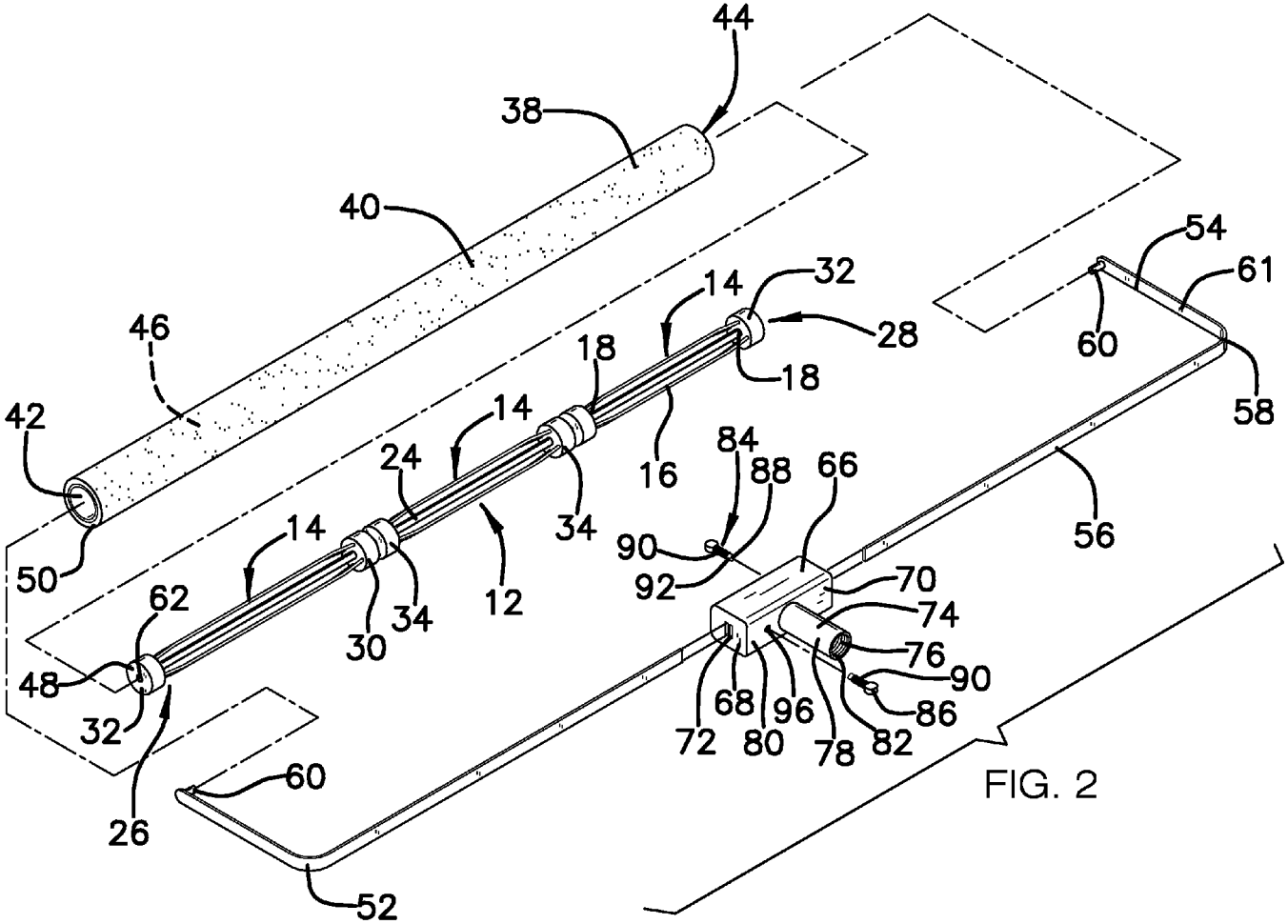
FIG. 2 is a partially-exploded top front side perspective view of an embodiment of the disclosure.
Figure 3:
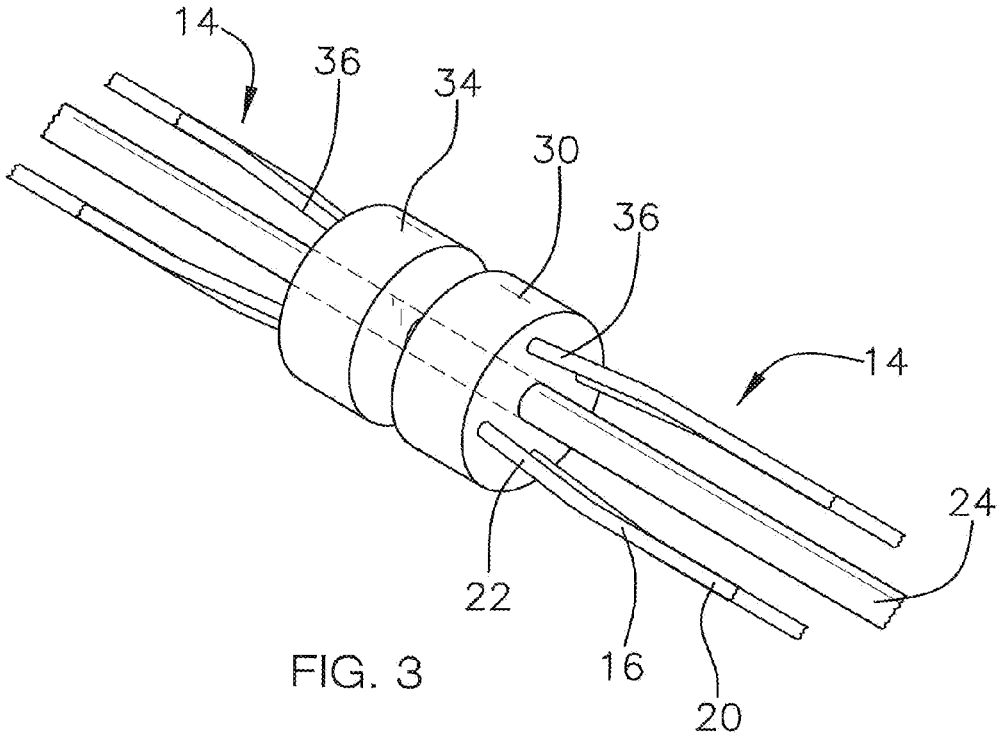
FIG. 3 is a cutaway top front side perspective view of an elongated cage of an embodiment of the disclosure.
Figure 4:
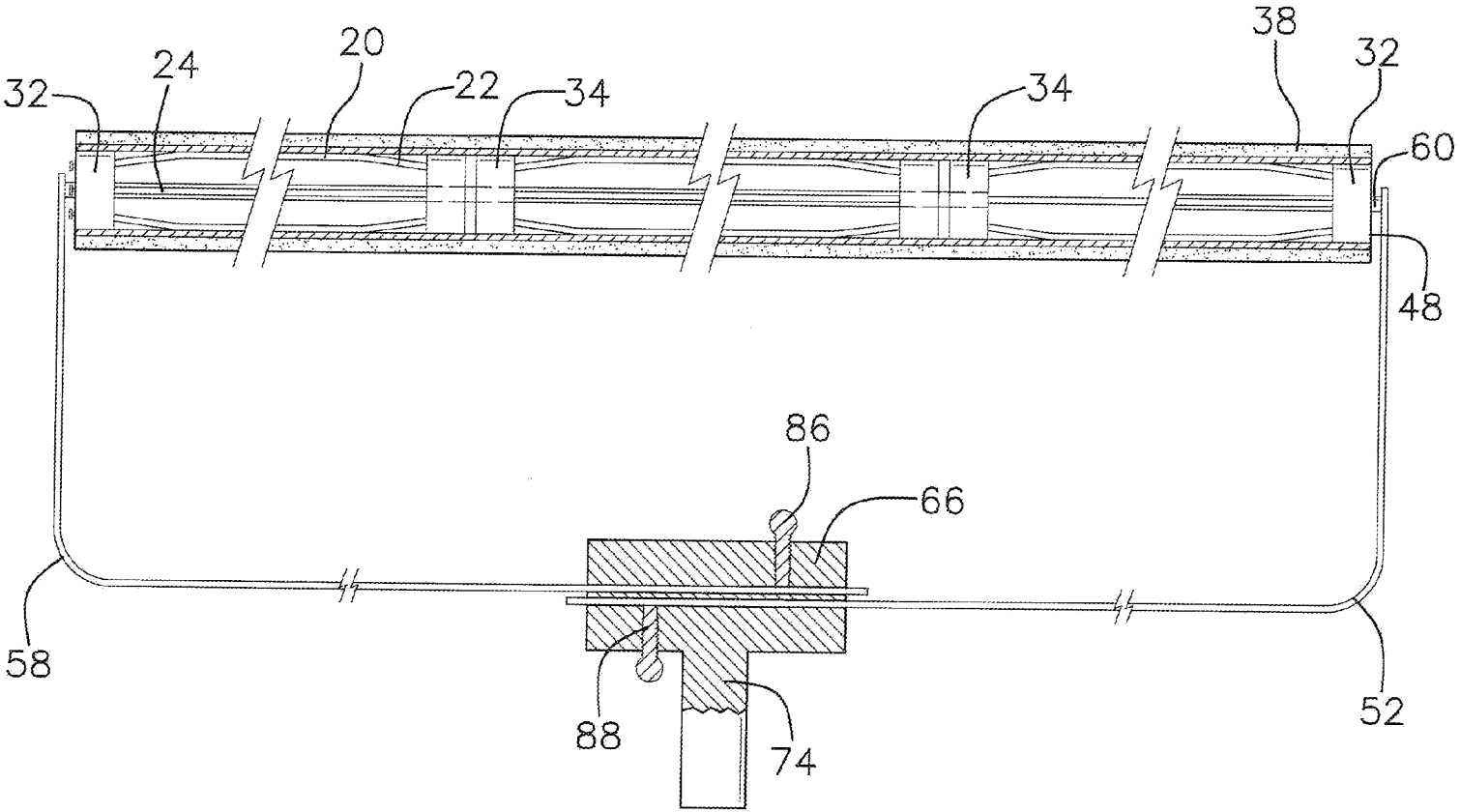
FIG. 4 is a cross-sectional top view of an embodiment of the disclosure taken along line 4-4 of FIG. 1.

With reference now to the drawings, and in particular to FIGS. 1 through 4 thereof, a new paint roller assembly embodying the principles and concepts of an embodiment of the disclosure and generally designated by the reference numeral 10 will be described.

As best illustrated in FIGS. 1 through 4, the paint roller assembly 10 generally comprises an elongated cage 12 having a plurality of removable sections 14. Each of the removable sections 14 has a plurality of bars 16 extending between opposite ends 18 of each of the removable sections 14 wherein the plurality of bars 16 comprises exactly four bars 16. Each of the bars 16 has a straight portion 20 and a pair of curved portions 22 wherein the straight portion 20 extends between each of the curved portions 22. The cage 12 has a rod 24 coupled to and extending between a first side 26 and a second side 28 of the cage 12. The rod 24 is centrally positioned in the cage 12. The rod 24 is preferably made from stainless steel. A pair of hubs 30 is coupled to each of the removable sections 14 wherein a hub 30 of one removable section 14 abuts a hub 30 of an adjacently positioned one of the removable sections 14. The hubs 30 are coupled to the ends 18 of the removable sections 14. The hubs 30 comprise a pair of outer hubs 32 and a plurality of inner hubs 34 wherein one of the outer hubs 32 is coupled to the first side 26 of the cage 12 and one of the outer hubs 32 is coupled to the second side 28 of the cage 12. The rod 24 extends between each of the removable sections 14. The rod 24 further extends between each of the hubs 30 positioned on each of the removable sections 14. The curved portions 22 of each bar 16 are coupled to the hubs 30 wherein a first side 36 of each of the curved portions 22 is coupled to an associated one of the hubs 30.

An elongated roller skin 38 has a main body 40, an open first side 42, and an open second side 44 wherein the main body 40, the open first side 42, and the open second side 44 define an interior space 46 configured for receiving the cage 12 wherein the cage 12 is slidably insertable into the interior space 46 of the roller skin 38 through one of the open first side 42 and the open second side 44 such that an outer edge 48 of one of the hubs 30 is aligned with a perimeter edge 50 of the roller skin 38 on a first side 26 of the cage 12 and said outer edge 48 of one of the hubs 30 is aligned with the perimeter edge 50 of the roller skin 38 on a second side 28 of the cage 12.

A pair of arms 52 is selectively couplable to the cage 12. The arms 52 are preferably made from stainless steel. Each of the arms 52 has a first side 54 and a second side 56. The first side 54 of the arms 52 meets the second side 56 of the arms 52 at a curved juncture 58. The first side 54 of the arms 52 is positioned perpendicular to the second side 56 of the arms 52. The first side 54 of each of the arms 52 has a pin 60 extending outwardly from an inner surface 61 of the first side 54 of the arms 52 wherein the pin 60 is configured for coupling the outer hubs 32 and the arms 52. The pin 60 is selectively insertable into an aperture 62 positioned on said outer edge 48 of said outer hubs 32. A head 66 is selectively coupled to each of the arms 52. The head 66 has a first side 68 and a second side 70. The first and second sides 68, 70 of the head 66 are selectively couplable to the second side 56 of each of the arms 52. A pair of slots 72 each extend from the first side 68 to the second side 70 of the head 66 wherein the second side 56 of each of the arms 52 is selectively insertable into an associated one of the slots 72 wherein the second side 56 of each of the arms 52 is configured to extend and retract to a desired length relative to a length of the cage 12. The slots 72 are spaced and horizontally aligned. A projection 74 is coupled to the head 66. The projection 74 has an open bottom 76 and a perimeter wall 78 coupled to and extending outwardly from the open bottom 76. The perimeter wall 78 is coupled to and extends outwardly from a front face 80 of the head 66. The open bottom 76 and the perimeter wall 78 of the projection 74 define a threaded interior 82 configured for receiving an extension pole such that the roller skin 38 is selectively extendable to a desired height.

A pair of fasteners 84 is couplable to the head 66. Each of the fasteners 84 has a top surface 86 and a shaft 88. The shaft 88 is coupled to and extends outwardly from the top surface 86. The shaft 88 of each fastener 84 has a threaded portion 90 and a non-threaded portion 92. One of the fasteners 84 is selectively insertable into a back face 94 of the head 66 and one of the fasteners 84 is selectively insertable into the front face 80 of the head 66 wherein each of the shafts 88 is configured to abut an associated one of the slots 72. The shafts 88 of each of the fasteners 84 are selectively insertable into a hole 96 positioned in an associated one of each of the front and back faces 80, 94 of the head 66. The top surface 86 of the fasteners 84 has a larger diameter than each of the holes 96 such that the top surface 86 is coupled to the front face 80 of the head 66 when the fasteners 84 are inserted into an associated one of each of the holes 96. The assembly 10 may be used to apply paint to hallways, ceilings, walls, roofs, driveways, tile, patios, and other areas.

Each of the cage 12 and the roller skin 38 may have a length between approximately 20 centimeters and 105 centimeters. The combined length of the head 66 and the second side 56 of each of the arms 52 may have a length between approximately 20 centimeters and 105 centimeters. Each of the removable sections 14 has a length between approximately 10 centimeters and 40 centimeters. The rod 24 has a length between approximately 40 centimeters and 115 centimeters. The head 66 has a length between approximately 25 centimeters and 75 centimeters.

In use, as stated above and shown in the Figures, the cage 12 is slidably inserted into the interior space 46 of the roller skin 38 through one of the open first side 42 and the open second side 44 such that an outer edge 48 of one of the hubs 30 is aligned with a perimeter edge 50 of the roller skin 38 on a first side 26 of the cage 12 and the outer edge 48 of one of the hubs 30 is aligned with the perimeter edge 50 of the roller skin 38 on a second side 28 of the cage 12. The second side 56 of each of the arms 52 is selectively inserted into an associated one of the slots 72 wherein the second side 56 of each of the arms 52 is configured to extend and retract to a desired length relative to a length of the cage 12. Paint is then applied to a surface and a user rolls the roller skin 38 over the paint on the surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A paint roller assembly comprising:

an elongated cage, said cage having a plurality of removable sections, each of said removable sections having a plurality of bars extending between opposite ends of each of said removable sections;

an elongated roller skin having a main body, an open first side, and an open second side wherein said main body, said open first side, and said open second side define an interior space configured for receiving said cage wherein said cage is slidably insertable into said interior space of said roller skin through one of said open first side and said open second side;

a pair of arms selectively couplable to said cage;

a head selectively coupled to each of said arms, said head having a first side and a second side, said first and second sides of said head being selectively couplable to a second side of each of said arms; and a slot extending from said first side and said second side of said head wherein said second side of each of said arms is selectively insertable into said slot wherein said second side of each of said arms is configured to extend and retract to a desired length relative to a length of said cage.

2. The assembly of claim 1, further comprising said plurality of bars comprising exactly four bars.

3. The assembly of claim 1, further comprising said cage having exactly three removable sections.

4. The assembly of claim 1, further comprising each of said removable sections measuring 22.86 centimeters.

5. The assembly of claim 1, further comprising a pair of hubs coupled to each of said removable sections wherein a hub of one removable section abuts a hub of an adjacently positioned one of said removable sections, said hubs being coupled to said ends of said removable sections.

6. The assembly of claim 5, further comprising an outer edge of one of said hubs being aligned with a perimeter edge of said roller skin on a first side of said cage, said outer edge of one of said hubs being aligned with said perimeter edge of said roller skin on a second side of said cage.

7. The assembly of claim 5, further comprising each of said arms having a first side and a second side, said first side of said arms meeting said second side of said arms at a curved juncture, said first side of said arms being positioned perpendicular to said second side of said arms.

8. The assembly of claim 7, further comprising said first side of each of said arms having a pin extending outwardly from an inner surface of said first side of said arms wherein said pin is configured for coupling each of said arms to said hubs, said pin being selectively insertable into an aperture positioned on an outer edge of said hubs.

9. The assembly of claim 7, further comprising said slot being a pair of slots each extending from said first side to said second side of said head wherein said second side of each of said arms is selectively insertable into an associated one of said slots wherein said second side of each of said arms is configured to extend and retract to a desired length relative to a length of said cage.

10. The assembly of claim 9, further comprising said slots being spaced and horizontally aligned.

11. The assembly of claim 9, further comprising a pair of fasteners couplable to said head, each of said fasteners having a top surface and a shaft, said shaft being coupled to and extending outwardly from said top surface.

12. The assembly of claim 11, further comprising one of said fasteners being selectively insertable into a back face of said head and one of said fasteners being selectively insertable into a front face of said head wherein each of said shafts is configured to abut an associated one of said slots.

13. The assembly of claim 12, further comprising said shafts of each of said fasteners being selectively insertable into a hole positioned in an associated one of each of said front and back faces of said head, said top surface of said fasteners having a larger diameter than each of said holes such that said top surface is coupled to said front face of said head when said fasteners are inserted into an associated one of each of said holes.

14. The assembly of claim 1, further comprising said cage having a rod coupled to and extending between a first side and a second side of said cage, said rod being centrally positioned in said cage.

15. The assembly of claim 14, further comprising said rod measuring 81.28 centimeters.

16. The assembly of claim 1, further comprising said roller skin measuring 91.44 centimeters.

17. The assembly of claim 1, further comprising a projection coupled to said head, said projection having an open bottom and a perimeter wall coupled to and extending outwardly from said open bottom, said perimeter wall being coupled to and extending outwardly from a front face of said head, said open bottom and said perimeter wall of said projection defining a threaded interior configured for receiving an extension pole such that said roller skin is selectively extendable to a desired height.

18. A paint roller assembly comprising:

an elongated cage having a plurality of removable sections, each of said removable sections having a plurality of bars extending between opposite ends of each of said removable sections wherein said plurality of bars comprises exactly four bars, each said bar having a straight portion and a pair of curved portions wherein said straight portion extends between each of said curved portions, said cage having a rod coupled to and extending between a first side and a second side of said cage, said rod being centrally positioned in said cage;

a pair of hubs coupled to each of said removable sections wherein a hub of one removable section abuts a hub of an adjacently positioned one of said removable sections, said hubs being coupled to said ends of said removable sections, said hubs comprising a pair of outer hubs and a plurality of inner hubs wherein one of said outer hubs is coupled to said first side of said cage and one of said outer hubs is coupled to said second side of said cage, said rod extending between each of said removable sections, said rod further extending between each of said hubs positioned on each of said removable sections, said curved portions of each said bar being coupled to said hubs wherein a first side of each of said curved portions is coupled to an associated one of said hubs;

an elongated roller skin having a main body, an open first side, and an open second side wherein said main body, said open first side, and said open second side define an interior space configured for receiving said cage wherein said cage is slidably insertable into said interior space of said roller skin through one of said open first side and said open second side such that an outer edge of one of said hubs is aligned with a perimeter edge of said roller skin on a first side of said cage and said outer edge of one of said hubs is aligned with said perimeter edge of said roller skin on a second side of said cage;

a pair of arms selectively couplable to said cage, each of said arms having a first side and a second side, said first side of said arms meeting said second side of said arms at a curved juncture, said first side of said arms being positioned perpendicular to said second side of said arms, said first side of each of said arms having a pin extending outwardly from an inner surface of said first side of said arms wherein said pin is configured for coupling said outer hubs and said arms, said pin being selectively insertable into an aperture positioned on said outer edge of said outer hubs;

a head selectively coupled to each of said arms, said head having a first side and a second side, said first and second sides of said head being selectively couplable to said second side of each of said arms, a pair of slots each extending from said first side to said second side of said head wherein said second side of each of said arms is selectively insertable into an associated one of said slots wherein said second side of each of said arms is configured to extend and retract to a desired length relative to a length of said cage, said slots being spaced and horizontally aligned;

a projection coupled to said head, said projection having an open bottom and a perimeter wall coupled to and extending outwardly from said open bottom, said perimeter wall being coupled to and extending outwardly from a front face of said head, said open bottom and said perimeter wall of said projection defining a threaded interior configured for receiving an extension pole such that said roller skin is selectively extendable to a desired height; and a pair of fasteners couplable to said head, each of said fasteners having a top surface and a shaft, said shaft being coupled to and extending outwardly from said top surface, said shaft of each said fastener having a threaded portion and a non-threaded portion, one of said fasteners being selectively insertable into a back face of said head and one of said fasteners being selectively insertable into said front face of said head wherein each of said shafts is configured to abut an associated one of said slots, said shafts of each of said fasteners being selectively insertable into a hole positioned in an associated one of each of said front and back faces of said head, said top surface of said fasteners having a larger diameter than each of said holes such that said top surface is coupled to said front face of said head when said fasteners are inserted into an associated one of each of said holes.

* * * * *